US009476194B1

(12) United States Patent
Hulka et al.

(10) Patent No.: US 9,476,194 B1
(45) Date of Patent: Oct. 25, 2016

(54) FRAMING CLIPS

(71) Applicant: USG Interiors, LLC, Chicago, IL (US)

(72) Inventors: Samuel D. Hulka, Mount Prospect, IL (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/844,434

(22) Filed: Sep. 3, 2015

(51) Int. Cl.
*E04B 1/38* (2006.01)
*E04B 1/41* (2006.01)
*E04F 19/06* (2006.01)

(52) U.S. Cl.
CPC ..... *E04B 1/40* (2013.01); *E04F 19/06* (2013.01); *E04B 2001/405* (2013.01)

(58) Field of Classification Search
CPC ..... E04B 1/40; E04B 2001/405; E04F 19/06
See application file for complete search history.

(56) References Cited

U.S. PATENT DOCUMENTS 4,572,695 A * 2/1986 Gilb ..... E04B 1/2608 248/300
5,217,317 A * 6/1993 Young ..... E04B 1/2612 403/14
6,295,781 B1 * 10/2001 Thompson ..... E04B 1/2608 403/232.1
7,178,305 B2 * 2/2007 Petrova ..... F16B 15/0046 52/714
8,615,958 B2 * 12/2013 Kilgore ..... E04F 15/02044 52/650.3
8,713,872 B2 * 5/2014 Rempel ..... E04B 1/2608 52/238.1
8,782,985 B2 7/2014 Gulbrandsen et al.
9,187,898 B1 * 11/2015 Underkofler ..... E04B 9/064
2007/0044421 A1 * 3/2007 Nguyen ..... E04B 7/063 52/698
2010/0053947 A1 * 3/2010 Fowler, Jr. ..... F21V 3/04 362/223

FOREIGN PATENT DOCUMENTS

DE 3905896 A1 * 8/1990 ..... E04F 13/081

* cited by examiner

*Primary Examiner* — Jeanette E Chapman
(74) *Attorney, Agent, or Firm* — Pearne & Gordon LLP

(57) ABSTRACT

A clip for attaching an extruded decorative trim strip of the type having a clip receiving track formed on the rear face of the strip to support structure, comprising a stamped one piece sheet metal body, the body being generally flat and generally rectangular in plan view, an attachment tab within a perimeter of the body, and partially separated from the body by slots at respective edges of the tab, the tab being foldable out of a plane of the body by application of a manually developed force, said tab being constructed when folded to assume an orientation in a plane outside of a plane of the body, the tab including a locking portion adapted to project from the plane of the body of the clip on a side of the clip opposite a side on which a major portion of the tab lies when folded.

4 Claims, 3 Drawing Sheets

FRAMING CLIPS

BACKGROUND OF THE INVENTION

The invention relates to architectural metal assemblies and, in particular, to a clip for joining extruded aluminum trim to metal framing elements.

PRIOR ART

Extruded aluminum trim has been available, for example, to finish the edges of island and peninsula suspended ceilings. These decorative trim pieces are available in several face widths and are primarily used in a vertical orientation. These trim pieces or strips have the potential to be used in other ceiling applications in both vertical and horizontal orientations such as at the perimeter of a ceiling. For example, windows may be shaded by a roll-up screen that extends from and retracts into a pocket above the plane of the suspended ceiling. The decorative trim could be used to box-in such a pocket if a suitable attachment bracket or clip was available for affixing the trim to the framing members.

SUMMARY OF THE INVENTION

The invention provides a novel metal clip that facilitates assembly of extruded aluminum decorative trim and framing elements such as sheet metal studs and joists. The clip is proportioned to slide into a mounting channel or track formed on a rear face of the trim. Preferably, the clip provides two separate connecting tabs that are individually deployable. Depending on the tab selected, the clip connects in a plane perpendicular or parallel to a longitudinal direction of a trim element. This universality saves the cost of manufacturing and inventorying two separate parts. Ideally, one of the tabs has a locking feature that when deployed, fixes the location of the clip relative to the trim strip.

Preferably, the clip is economically produced as a one-piece sheet metal stamping. An initial flat configuration reduces the complexity of the stamping operation, packaging cost, inventory space, and shipping cost. Additionally, the flat configuration enables a technician to carry many pieces without excessive bulk and without expenditure of extraneous motion or attention to bring a clip to a proper orientation.

DESCRIPTION OF THE PREFERRED EMBODIMENT

Figure 1:
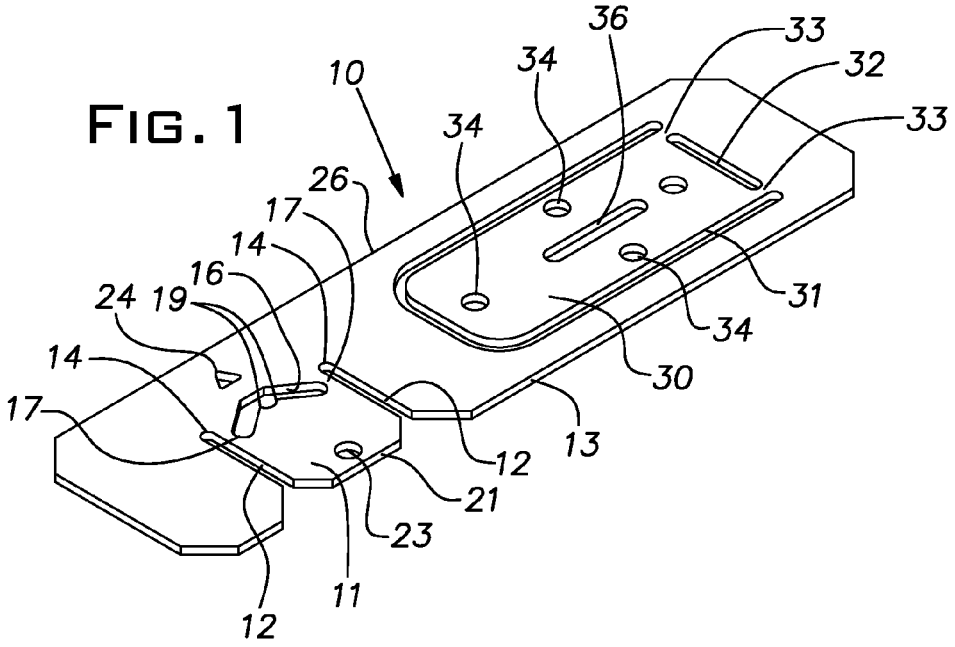
FIG. 1 is an isometric view of an example of a framing clip of the invention.

Referring to the drawings, a clip 10 embodying the invention is a one-piece sheet metal stamping. The illustrated clip 10 is a generally rectangular elongated body made, for example, of 0.040 inch gauge G30 galvanized steel. A first tab 11 is cut out of the clip body by stamping a pair of spaced slots 12. The slots are open at a long edge 13 of the body and extend to inner ends 14. An end slot 16, in the shape of a shallow V, extends longitudinally of the clip body between the slots 12. The end slot 16 stops short of the side slots 12 leaving the tab 11 connected to the main body of the clip 10 at land areas 17. A side of the end slot 16, contiguous with the tab 11 is irregular so as to provide a pair of projections or teeth 19 at a valley of the slot. The tab 11 extends away from the lands 17 in a direction perpendicular to the longitudinal direction of the clip 10. A free end 21 of the tab 11 is spaced inwardly from an imaginary line that joins interrupted portions of the long edge 13 of the clip 10. A hole 23 is formed in the tab 11 adjacent the distal or free end 21 of the tab. A triangular hole 24 is formed in the clip between the end slot 16 and a long edge 26 of the clip 10.

A second tab 30 is formed in the body of the clip 10 by a U-shaped slot 31. A transverse slot 32 extends between ends of the U-shaped slot 31 leaving areas of sheet material or lands 33. The tab 30 extends away from the lands 33 in the longitudinal direction of the clip 10. A series of holes 34 are situated near the periphery of the tab 30 and a longitudinal slot 36 is centered in the tab. For reference, the length of the clip 10 can be nominally 5¾ inch. The width of the clip is selected to provide a sliding fit in a pair of opposed flanges provided on the rear face of an extruded aluminum decorative trim discussed below in connection with FIG. 7. The clip 10 is manufactured and distributed in the flat or planar configuration shown in FIG. 1.

Figure 5:
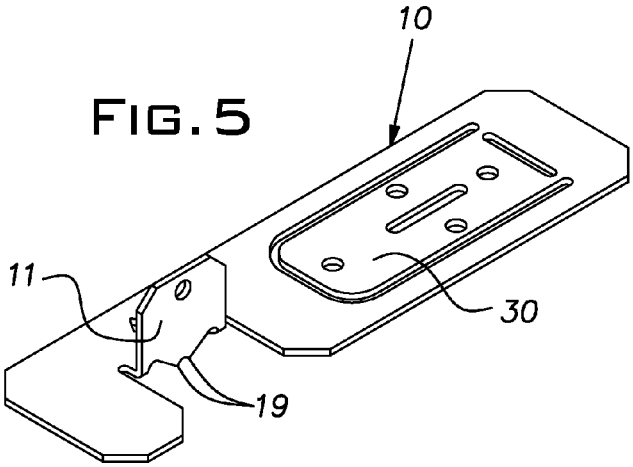
FIG. 5 is an isometric view of the clip with a different tab deployed.
Figure 6:
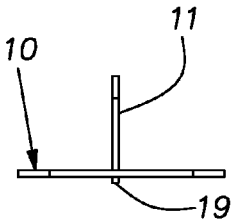
FIG. 6 is an end view of the clip of FIG. 5.

FIGS. 5 and 6 illustrate a condition of the clip where the first described tab 11 is deployed by manually bending it up perpendicular to the plane of the clip 10 for attaching an extruded trim member to an adjacent frame member.

Figure 3:
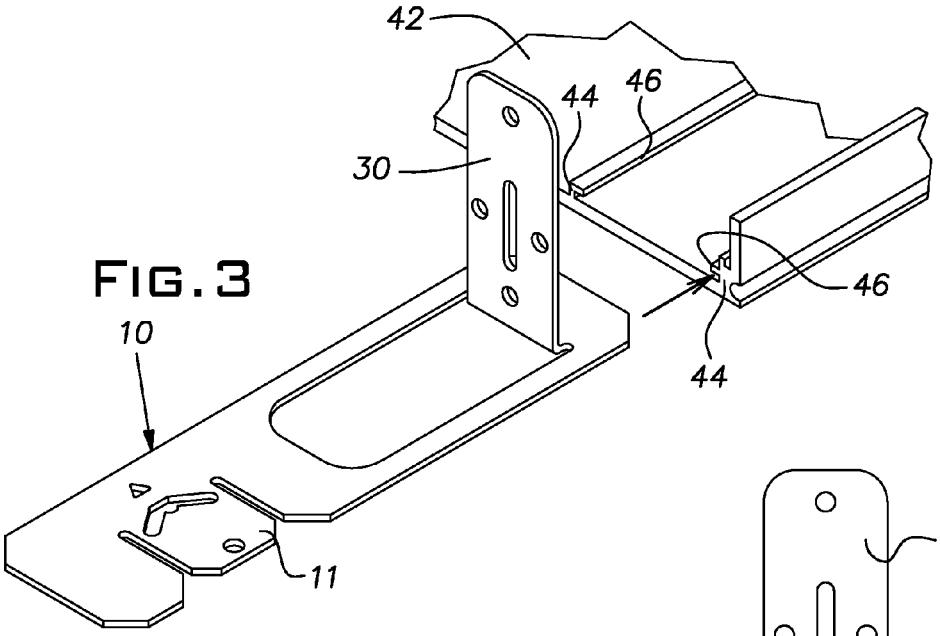
FIG. 3 is an isometric view of the clip with one tab deployed.
Figure 4:
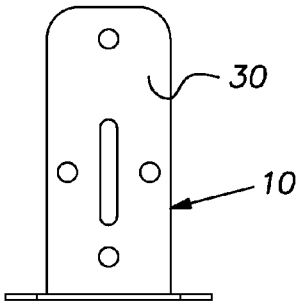
FIG. 4 is an end view of the clip of FIG. 3.

FIGS. 3 and 4 illustrate the second described tab 30 similarly deployed by manually bending it up until it is perpendicular to the plane of the clip 10.

When deployed, the tab 11 is in a plane parallel to the longitudinal direction of the clip 10 and the tab 30 is in a plane perpendicular to the longitudinal direction of the clip.

Figure 7:
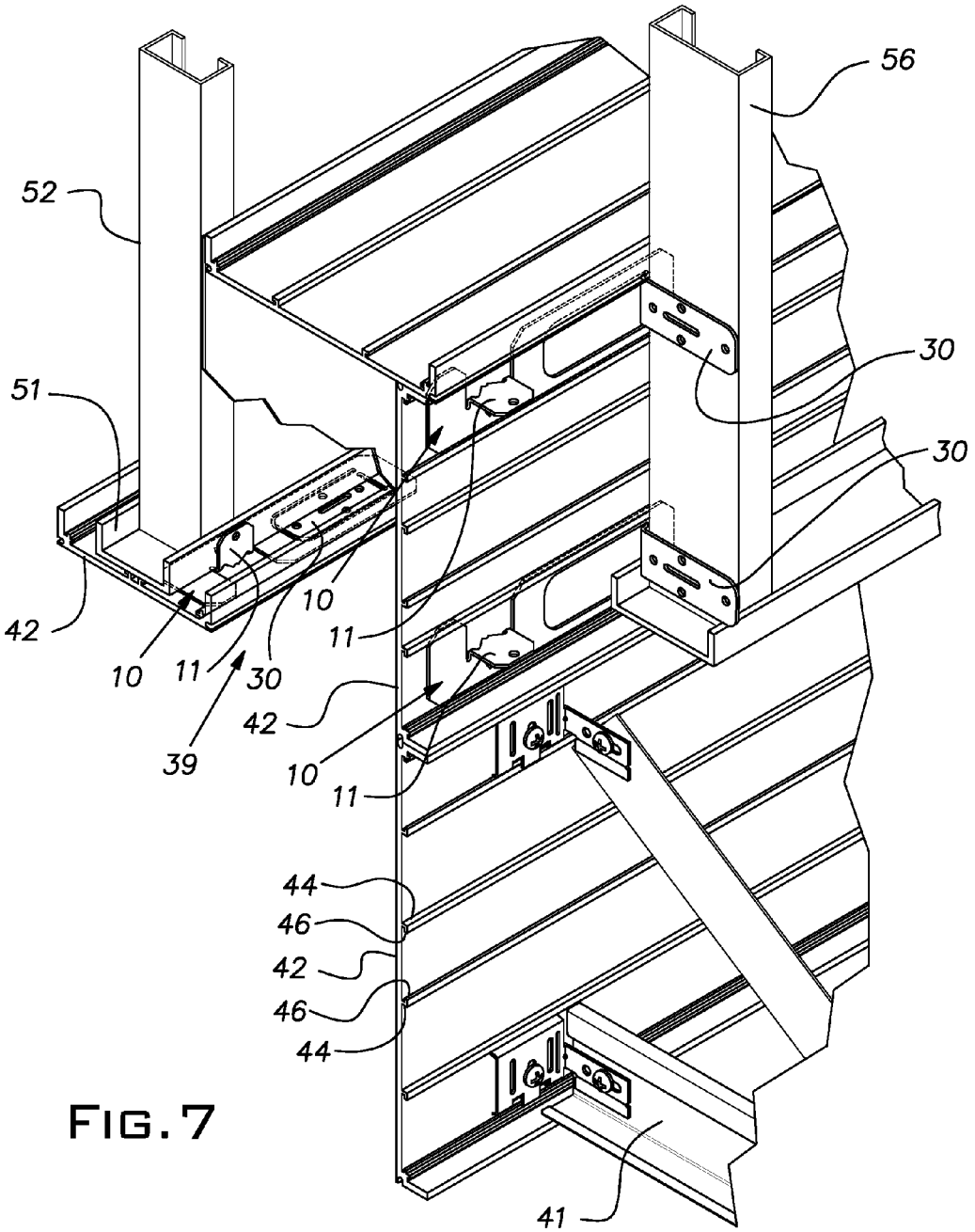
FIG. 7 is a fragmentary isometric view of an installation of trim strips in which the inventive clip is employed.

Referring to FIG. 7, there is shown an isometric fragmentary view of a structure forming an open bottom pocket 39 constructed, for example, at the perimeter of a room ceiling for housing a roll-up shade or screen. A pair of vertically oriented, extruded aluminum trim strips 42 are stacked, one on the other, to provide a desired elevation of the pocket 39 above a plane of a suspended ceiling represented by a conventional grid runner 41. The illustrated decorative strips are commercially available from USG Interiors, LLC, being marketed under the trademark COMPASSO® ELITE. As shown most clearly in FIG. 3, each strip 42 has a pair or pairs of mutually facing longitudinally extending flanges 44 on its back side or face. All of the flange pairs are spaced a predetermined distance to mutually form a track which accommodates the clip 10 disclosed hereinabove. The flanges 44 have lips 46 at their distal edges which serve to retain or capture a clip 10 in the track. Clips 10 are assembled with the extruded decorative strips 42 by sliding them in a respective track formed by a pair of flanges 44 from an end of the strip.

On the left of FIG. 7, a trim strip 42 is disposed in a horizontal plane. The strip 42 is attached for support to a sheet metal channel or track 51. The track 51 receives lower ends of horizontally spaced sheet metal furring channels serving as studs 52 in a conventional manner. More specifically, the trim 42 is attached to the framing with the clip 10 of the invention. In this configuration, the clip 10 is used with the tab 11 which deploys in a longitudinal plane relative to the clip as shown in FIG. 5.

With the clip 10 located properly in the trim track, the tab 11 is manually folded up into a plane perpendicular to the clip. This can be facilitated with, for example, the use of a flat blade screwdriver. The land areas 17 cooperate to form a hinge line for pivotal displacement of the tab 11. The distal or free edge 21 of the tab 10 is located inward of the adjacent lip 46 of the trim flange 44 to enable deployment of the tab 11.

Figure 2:
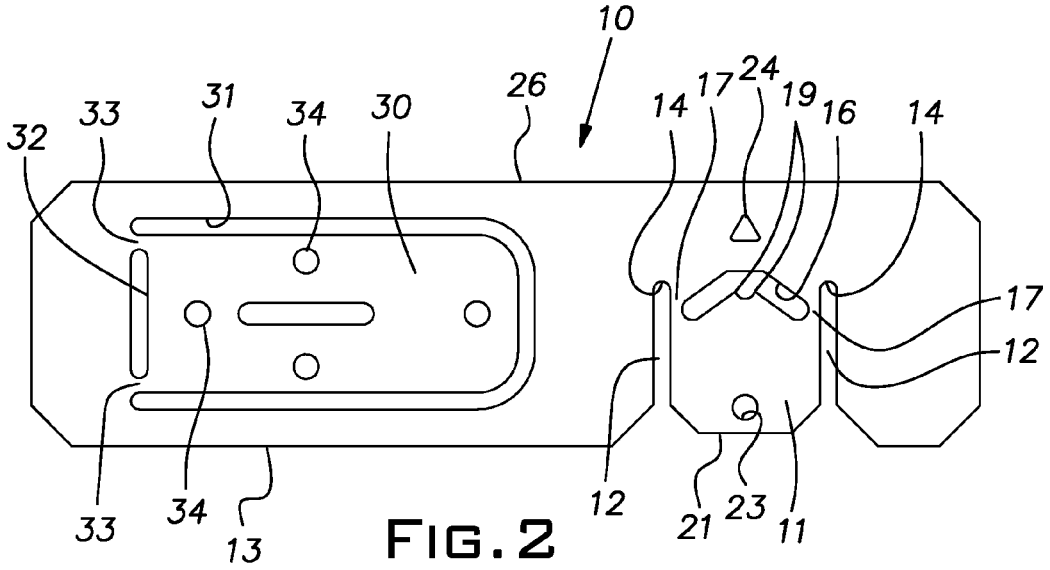
FIG. 2 is a plan view of the clip.

It will be understood from inspection of FIGS. 2, 5 and 6, that the projections or teeth 19 extend slightly out of the plane of the clip 10 when the tab 11 is folded up. This results from the offset of the teeth 19 from a hinge line passing through the lateral center of the land area 17, i.e. the center measured in the side-to-side direction of the clip. The teeth 19 are laterally outward of such land centers. When the tab 11 is folded up, the clip 10 is mechanically locked in the trim track by interference between the teeth 19 and the trim strip 48. The flange lips 46 closely limit movement of the clip 10 away from the strip 42.

A self-drilling screw is located in the hole 23 and driven into the track 51 or other framing member to attach the trim strip 42 thereto. As mentioned, a clip 10 can be situated in the other trim track (to the left of the track in which the clip 10 is shown in FIG. 7) so that it is on the opposite side of the framing track 51. Clips 10 can be located across from one another or on staggered centers along the length of the track 51.

With reference to the right side of FIG. 7, the clip 10 is used to attach a vertically oriented trim strip 42 to vertical framing studs 56. The tab 30 is manually folded out of the plane of the clip body, i.e. into the configuration of FIG. 3, and the clip is slid along the trim strip track until it abuts the frame element 56. One or more self-drilling screws is positioned in one or more of the holes 34 and/or slot 36 of the tab 30 and driven into the framing stud 56 to attach the trim strip 42 thereto. Where the transverse tab 30 is deployed to fix the clip 10 to a framing member, the clip 10 can be fixed along a trim track by also deploying the longitudinal tab 11. As discussed above, the longitudinal tab deployment mechanically locks the clip 10 in position along the trim track by interference of the teeth or projections 19 with the backside of the trim.

The versatility of the clip 10 can be appreciated when it is realized that the longitudinal tabs 11 can also be used to attach vertically oriented trim strips to framing members and the transverse tabs 30 can also be used to attach horizontally oriented trim strips to framing members. As many clips can be used with a specific trim element as necessary to sustain anticipated forces and/or maintain squareness or straight visual lines.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A clip for attaching an extruded decorative trim strip of the type having a clip receiving track formed on a rear face to support structure comprising a stamped one piece sheet metal body, the body being generally flat, lying in a plane and being generally rectangular in plan view, a pair of attachment tabs within the perimeter of the body and partially separated from the body by slots at respective edges of the tabs, and attached to the body by lands at respective opposite edges, each said tab being constructed to be folded about a hinge line between the respective lands, the tabs being individually foldable out of a plane of the body by application of a manually developed force, one of said tabs being constructed when folded to assume an orientation in a plane parallel to a longitudinal direction of the clip and another of the tabs being constructed when folded to assume an orientation in a plane transverse to the longitudinal direction of the clip, the tabs each having a hole for receiving a screw for attaching the clip to a support whereby, when the clip is disposed in a decorative trim strip track, the clip is adapted to serve to attach the trim strip to the support, and one of the tabs having at least one locking projection adjacent the lands.

2. A clip for attaching an extruded decorative trim strip of the type having a clip receiving track formed on the rear face of the strip to support structure, comprising a stamped one piece sheet metal body, the body being generally flat and generally rectangular in plan view, an attachment tab within a perimeter of the body, and partially separated from the body by slots forming edges of the tab, the tab being foldable out of a plane of the body by application of a manually developed force, said tab being constructed when folded about a hinge line formed by lands between said slots on opposite sides of the tab to assume an orientation in a plane outside of a plane of the body, the tab including an integral locking portion adjacent the lands and the tab adapted to fold about the hinge line and project from the plane of the body of the clip.

3. A clip as set forth in claim 2, wherein the locking portion includes projecting teeth.

4. A clip as set forth in claim 2, wherein said tab is constructed and arranged to hinge about a line parallel to a longitudinal direction of the clip.

* * * * *